United States Patent [19]

Manabe

[11] 4,151,965

[45] May 1, 1979

[54] APPARATUS FOR COILING

[75] Inventor: Hikaru Manabe, Hiratsuka, Japan

[73] Assignee: Nihon Biso Kabushiki Kaisha, Japan

[21] Appl. No.: 779,533

[22] Filed: Mar. 21, 1977

[30] Foreign Application Priority Data

Apr. 6, 1976 [JP] Japan ..... 51-42296[U]

[51] Int. Cl.[2] ..... B21C 47/00

[52] U.S. Cl. ..... 242/54 R; 242/83; 242/129; 254/134.3 FT

[58] Field of Search ..... 242/54 R, 82, 83, 129, 242/55, 21; 254/134.3 FT; 15/1 R, 104.3, 104.4, 104.5, 104.6

[56] References Cited

U.S. PATENT DOCUMENTS

| | | | |
|---|---|---|---|
| 2,223,005 | 11/1940 | Kerber | 242/54 R |
| 2,269,406 | 1/1942 | Crane | 242/54 R |
| 3,224,707 | 12/1965 | Arnold | 242/129 |
| 3,272,455 | 9/1966 | Sternberg et al. | 242/83 |
| 3,392,960 | 7/1968 | Bye | 242/129 |
| 3,534,423 | 10/1970 | Ratliff | 242/54 R |

*Primary Examiner*—George F. Mautz

*Attorney, Agent, or Firm*—Robert E. Burns; Emmanuel J. Lobato; Bruce L. Adams

[57] ABSTRACT

An apparatus for coiling, storing and uncoiling a wire rope. The apparatus includes a closed container rotatable about an axis thereof and defining a circular space in which to receive the wire rope. A conduit for guiding the wire rope into the interior of the container is rotatably disposed therein in alignment with the axis of rotation of the container. The conduit has an inlet which opens to the exterior of the container, and has an outlet which extends radially and athwart within the container. When the wire rope is introduced lengthwise into the inlet of the conduit, a relative rotation occurs between the container and the conduit, coiling the rope along the sidewall of the container.

1 Claim, 2 Drawing Figures

APPARATUS FOR COILING

FIELD AND BACKGROUND OF THE INVENTION

The invention relates to an apparatus for coiling and storing a flexible material of substantial length such as a wire rope having sufficient stiffness to withstand a reasonable degree of axial compression.

One application of such an apparatus is found in a structure sometimes called a gondola, for construction and cleaning purposes, which is suspended from the attic so as to be elevatable along the external wall of a building. In this application, a wire rope is utilized for suspension and pulled by a friction hauling machine to move the gondola up and down. Desirably a length of the rope which is hauled in is coiled in order to facilitate its uncoiling. U.S. Pat. No. 3,224,470 issued Dec. 21, 1965 to C. H. Arnold discloses an apparatus for coiling and uncoiling a wire rope, which comprises a base having a central post fixedly mounted thereon, and a rotatable container which defines an annular space around the post for receiving a wire rope. As a wire rope is fed into the container through guide means, the rope causes the container to rotate in one direction while the rope itself is coiled into the container. The container has an open top, which is opposed by a cover plate secured to the central post with a small clearance therebetween. The guide means mentioned above includes a conduit extending athwart and secured to the cover plate. The conduit functions to feed the wire rope into the container in a direction tangential to the receiving space while spacing to run athwart relative to the bottom of the container.

However, the described apparatus suffers from several disadvantages. A major difficulty is the fact that as the wire rope is coiled along the sidewall of the container and eventually reaches the top end of the sidewall, it comes into contact with the cover plate secured to the central post, thereby interfering with a smooth rotation of the container by friction. This results in an axial movement of the wire rope being resisted to cause a slack therein before the rope reaches the conduit. The slack tends to increase rapidly as a result of the gravity of the rope, preventing the conduit from fanctioning as a guide means. Another difficulty of the apparatus resides in the outward projection of the conduit from the cover plate, which prevents a stacking of the apparatus during shipment or storage.

SUMMARY OF THE INVENTION

Therefore, it is an object of the invention to provide an apparatus for coiling a wire rope for storage, which is provided with an upright conduit for guiding the wire rope along the axis of rotation of a rotatable container so that the container may be provided with a bottom wall and also a top wall.

In accordance with the invention, there is provided an apparatus for coiling a wire rope which comprises a support member having a base, a container having a circular space defined by a cylindrical sidewall and a bottom and a top wall at the opposite ends of the sidewall, first mounting means for mounting the container on the support member for rotation about an axis of rotation which coincides with the center axis of the circular space, a guide conduit disposed within the container in alignment with the axis of rotation and having one end which extends through the top wall and defining an inlet opening externally of the top wall and having other end which extends radially and athwart toward the sidewall to define an outlet chute, and second mounting means for supporting the guide conduit in a manner to permit a relative rotation between the conduit and the container.

In a preferred embodiment of the invention, the support member is in the form of a housing for the container, which rotatably supported by means of bearings located on both the base and the top of the housing. The lower portion of the guide conduit is integrally formed with a support pipe. It is preferred that the guide conduit and the support pipe form together a shaft for the container, but the construction of the support pipe is not limited to this form alone. Since it is only necessary that a relative rotation be possible between the guide conduit and the container, the conduit may be secured to the support member. However, for practical purposes, it is desirable that the conduit be rotatable relative to the support member as is the container.

DETAILED DESCRIPTION OF PREFERRED EMBODIMENT

Figure 1:
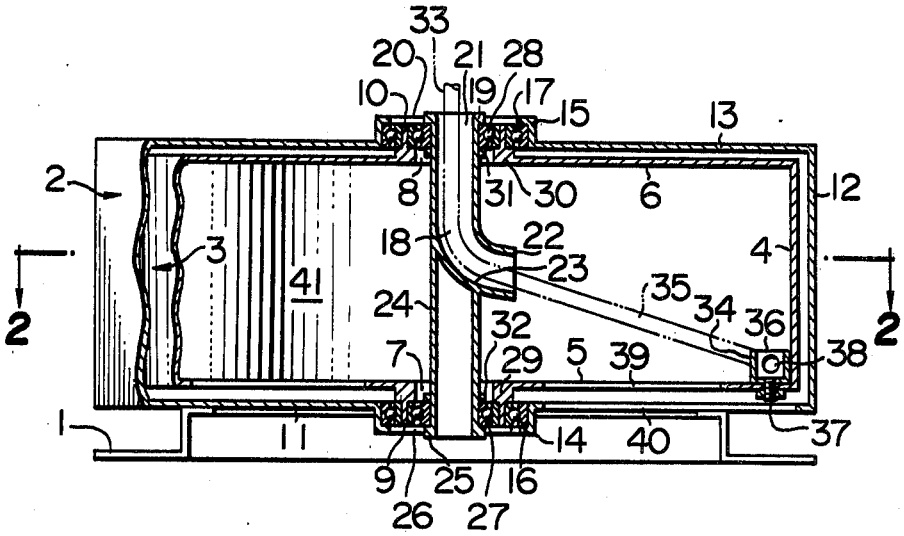
FIG. 1 is a side elevation, partly in longitudinal section, of the apparatus according to the invention.
Figure 2:
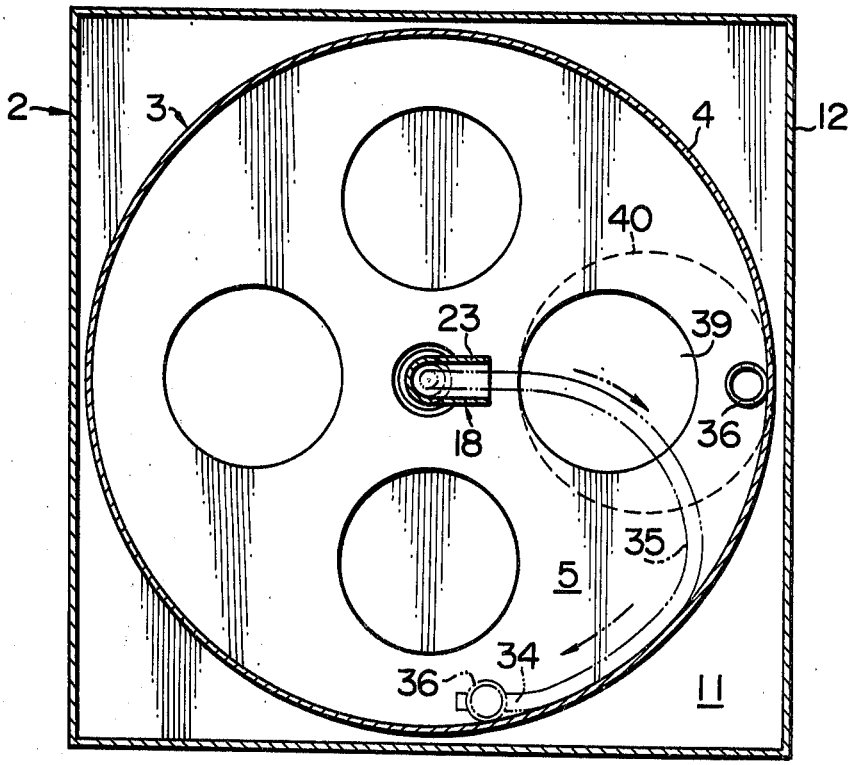
FIG. 2 is a cross section taken along the line 2—2 shown in FIG. 1.

Referring to FIGS. 1 and 2, the apparatus according to the invention includes a rectangular housing 2 secured to a base 1. A container 3 is disposed within the housing 2, and includes a cylindrical sidewall 4, and a bottom wall 5 and a top wall 6 integrally connected with the opposite ends of the sidewall 4. Both the bottom and top walls 5, 6 are formed with apertures 7, 8 of a suitable radius, respectively, which are aligned with the axis of the cylindrical sidewall 4. Sleeves 9, 10 extend integrally and outwardly from the bottom and top walls 5, 6, respectively, coaxially with the apertures 7, 8. The housing 2 comprises a floor 11, four sidewalls 12 and a top 13, and the floor 11 and the top 13 are formed with recesses 14, 15, respectively, for receiving the sleeves 9, 10 extending from the container 3. A pair of bearings 16, 17 are received in the recesses 14, 15 to support the sleeves 9, 10, thus rotatably carrying the container 3 within the housing 2.

A guide conduit 18 is disposed within the container 3 in alignment with the axis of rotation thereof, and has one end 19 which extends through the top aperture 8 into an aperture 20 formed in the recess 15 of the housing, where it opens to forms an inlet 21. The other end 22 of the conduit 18 extends athwart, that is, as shown obliquely relative to the bottom wall 5 of the container 3, and defines a radially extending outlet chute 23. In the embodiment shown, a support pipe 24 is formed integrally with the conduit 18 and in alignment with the axis of rotation of the container 3. The support pipe 24 has an outer end 25 which extends through the aperture 7 in the bottom wall 5 of the container to the plane of an aperture 26 formed in the recess 14 of the floor 11. Both the guide conduit 18 and the support pipe 24 are rotatably supported by the container 3 by means of a pair of bearings 27, 28 interposed between the sleeves 9, 10 and these members. Each of the sleeves 9, 10 is also provided with a thrust bearing 29 or 30 associated with the bearing 27 or 28. Thrust bearings 31, 32 are formed around the guide conduit 18 and the support pipe 24, respectively, thus preventing an axial movement of the conduit 18 and the pipe 24. While not shown, the floor 11 and the top 13 of the housing 2 may be provided with suitable bearing covers. It will be readily understood that the bearings 27, 28 may be disposed between the conduit 18 and the top 13 and between the support pipe 24 and the floor 11 of the housing 2, respectively. It will be seen that in the apparatus of the invention, projection of the conduit 18 outward from the housing 2 can be avoided, thus permitting a stacking of the apparatus during shipment or storage.

When the apparatus is initially used, one end 34 of a wire rope 33 is axially introduced into the inlet 21 of the guide conduit 18. As the feeding of the rope is continued, the end 34 passes through the outlet chute 23 and eventually abuts against the lower portion of the sidewall 4 of the container 3. By applying an increased force to the rope 33 momentarily, part 35 of the rope extending between the chute 23 and the sidewall 4 can be slightly flexed so that the stiffness of the rope then causes a lateral side of the end 34 to bear against the sidewall 4. Thereupon, the axial force applied to the rope 33 causes a rotation of the container 3 relative to the guide conduit 18. Subsequent feeding in of the wire rope 33 with a force of an ordinary magnitude causes a sequential coiling of the rope along the sidewall 4 in an upward direction as the container continues to rotate relative to the guide conduit. When an outermost tier of the rope 33 is completely formed as the latter reaches the top wall 6 of the container 3, a next outermost tier begins to form against the initial tier, starting in the uppermost region and sequentially coiling downward. A similar operation continues to coil the rope 33 in an annular space 41 in the container 3. It will be understood that the rope may be uncoiled by an opposite procedure.

In the apparatus shown in FIGS. 1 and 2, the conduit 18 is rotatable relative to both the container 3 and the housing 2. This results in a complex manner of rotation between the conduit 18 and the container 3. During an initial rotation that occurs immediately after the abutment of the rope end 34 against the sidewall 4, either conduit 18 or container 3 may rotate alone, or they may both rotate in opposite directions, depending on the situations of use. However, it is obvious that the capability of the guide conduit 18 and the container 3 independently from each other advantageously facilitates a triggering of the initial relative rotation. During the normal phase of relative rotation, the conduit 18 will not rotate in all probabilities while the container 3 will rotate alone. This is because a rotation of the conduit 18 involves a twisting of the rope 33 and hence encounters an increased resistance to rotation as compared with the rotation of the container 3. Nevertheless the conduit 18 does rotate in order to compensate for any excessive twisting or untwisting of the rope.

In many applications of the apparatus described, once introduced inside the container 3, the rope end 34 remains therein while the coiling and uncoiling operation of the rope is repeated. For this reason, a fixture 36 is provided inside the container in accordance with the invention for frictionally locking the rope end 34. The fixture 36 may be anchored to the bottom wall 5 adjacent to the periphery thereof by means of a set screw 37. The fixture 36 is formed with an opening 38 which extends substantially parallel to the bottom wall 5 along the sidewall 4. The rope end 34 is manually inserted into the opening 38 after passing it through the conduit 18. At this end, the bottom wall 5 of the container 3 and the floor 11 of the housing 2 are formed with openings 39, 40, respectively, which permit an access to the interior of the container. When the rope 34 is engaged with the fixture 36, the rope part 35 extending between the chute 23 and the fixture 36 will be flexed as shown in phantom lines in FIG. 2, and the stiffness of the rope causes a strong frictional engagement of a lateral side thereof with the sidewall 4. Thus an unintended disengagement of the rope end 34 from the fixture 36 is prevented, and the apparatus is ready to coil the rope as it is fed with an ordinary axial force.

While the invention has been particularly shown and described with reference to a specific embodiment thereof, it will be understood that the invention is not limited thereto but is subject to a number of modifications and changes without departing from the spirit and scope of the invention. By way of example, the housing may be replaced by a framework and the container formed as a cage structure.

Having described the invention, what is claimed is:

1. Apparatus for coiling wire rope which can withstand axial compression, comprising; a support; an enclosed container having a cylindrical sidewall, a bottom wall and a top wall to define an enclosed circular space; first mounting means for mounting the container on the support for rotation about the axis of the circular space; a conduit disposed in the container, aligned with the axis, having one end which extends through the top wall and defines an inlet opening externally of the top wall for inserting a wire rope therethrough which can withstand axial compression, and having another end which defines an outlet chute internally of the container between the top and bottom walls and which extends radially and athwart toward the side and bottom walls; second mounting means for mounting the conduit so as to make it freely rotatable relative to the container, the second mounting means being aligned with said first mounting means perpendicularly of the axis, the first mounting means constituting a bearing, the container being mounted free to rotate freely on said bearing under control of relative engagement of the wire rope and an inner surface of the container and under control of the wire rope when the wire rope is fed longitudinally into said conduit and into said circular space thereby to coil said wire rope in said space and to rotate in an opposite direction as said wire rope is withdrawn longitudinally from said conduit thereby to uncoil said rope as it is withdrawn.

* * * * *